US005803247A

United States Patent [19]

Holmes et al.

[11] Patent Number: 5,803,247

[45] Date of Patent: Sep. 8, 1998

[54] PORTABLE HUMIDOR

[76] Inventors: Jeremy S. Holmes, 16 High Hill Rd., Canton; Marc W. Trahan, 21 Robbinswood Dr., Wethersfield, both of Conn. 06109; Peter V. Disch, 210 Wightman Ave., Norwich, Conn. 06360

[21] Appl. No.: 850,999

[22] Filed: May 5, 1997

[51] Int. Cl.[6] ..... A24F 25/02

[52] U.S. Cl. ..... 206/213.1; 206/256; 312/31.1

[58] Field of Search ..... 206/205, 213.1, 206/242, 256, 523; 229/909; 62/176.4; 312/31.1

[56] References Cited

U.S. PATENT DOCUMENTS

| | | | |
|---|---|---|---|
| 1,662,744 | 3/1928 | Hardee | 206/256 |
| 1,678,260 | 7/1928 | Martino et al. | 312/31.1 |
| 2,860,023 | 11/1958 | Herdlitchka | 312/31.1 |
| 5,607,051 | 3/1997 | Espinosa | 206/213.1 |

FOREIGN PATENT DOCUMENTS

| | | | |
|---|---|---|---|
| 2599719 | 12/1987 | France | 206/256 |

*Primary Examiner*—David T. Fidei
*Attorney, Agent, or Firm*—McCormick, Paulding & Huber

[57] ABSTRACT

In a portable humidor, a base includes a first interior area, and a cover includes a second interior area and is connected to the base via at least one hinge for movement between an open and a closed position. A permeable-shock-absorbing insert is positioned in the first interior area and includes a plurality of channels, each adapt to receive and isolate a cigar from adjacent cigars. A permeable-shock-absorbing liner is positioned in the second interior area and defines at least two cutouts for receiving a humidifier and a hygrometer. A seal is provided between the cover and the base, such that when the humidor is in the closed position it is vapor tight. At least two shelves can be positioned in the first interior area and are linked to each other and the humidor, such that when the cover is opened the two shelves move to an offset spaced apart position. A tray having a permeable-shock-absorbing tray insert defining a plurality of channels can be located on the shelves. In addition, the tray insets and the base insert each include a plurality of slots positioned adjacent to the channels each slot for retaining a strip of cedar to aid in aging the cigars stored in the humidor.

20 Claims, 4 Drawing Sheets

PORTABLE HUMIDOR

FIELD OF THE INVENTION

The present invention relates generally to the storage of cigars, and more particularly to humidors capable of withstanding extremes in climate.

BACKGROUND OF THE INVENTION

The smokable life of a cigar is directly related to the conditions under which the cigar is stored. If stored at the proper temperature and humidity levels, a cigar can be maintained in a smokable condition indefinitely. However, if stored improperly the smokability of the cigar deteriorates rapidly rendering the cigar unsmokable in a very short time. The ideal environment for cigar storage is one that recreates the tropical climate in which the tobacco plants, from which cigars are made, were grown. In general this means storing the cigars in an atmosphere of 68–70 degrees Fahrenheit and a humidity level of 70–72%.

In attempting to recreate the conditions described above, cigars are typically stored in what are referred to as humidors. A humidor is essentially a box which contains a device for maintaining a constant humidity level in its interior, and which when closed, should seal the interior of the box from the ingress of outside air. Most often humidors are constructed of wood with the interior lined with cedar. Typically, these wooden humidors are quite expensive, elaborate items meant to appear and function as furniture, and as such are not overly rugged. Moreover, since most humidors are not meant to be moved from place to place, the cigars are stored loosely inside. Therefore, if the humidor is moved or transported, the cigars will move relative to each other potentially damaging the cigar's delicate wrapper.

Based on the foregoing, the problem exists in that if a person must travel, he/she must either bring his/her cigars with him/her and risk them being damaged and/or drying out, or hope that he/she is fortunate enough to find a cigar shop at their final destination. If the person is going on a hunting, camping or other outdoor trip, the likelihood of finding a local cigar shop can be remote. Moreover, any cigars brought on the trip will potentially be exposed to extremes in weather and/or climate conditions which will significantly impair the smokability of a cigar.

Accordingly, and in keeping with the above, it is the general object of the present invention to provide a rugged portable humidor capable of withstanding the rigors of travel, as well as varying weather and climate conditions while securely retaining, and maintaining the smokable integrity of the cigars stored inside.

SUMMARY OF THE INVENTION

The present invention resides in a portable humidor comprising a base and a cover that can be moved between an open and a closed position. The base and cover are connected to one another via hinges with the base defining a first interior area and the cover defining a second interior area. Both the cover and base are preferably formed from a torsionally rigid plastic with at least one permeable-shock-absorbing insert positioned in the base and having means for supporting a plurality of cigars in an isolated relationship relative to one another. A permeable-shock-absorbing liner is positioned in, and coupled to the interior area of the cover, such that when the cover is moved from the open to the closed position, any cigars stored in the portable humidor are retained between the liner in the cover and the insert in the base. The aforementioned liner defines at least two cutouts with a humidifier positioned in one of the cutouts and coupled to the cover and a hygrometer positioned in another cutout and also coupled to the cover. In order to maintain the proper climate and prevent the ingress of air, the portable humidor is provided with sealing means interposed between the cover and the base, as well as means for releasably, sealingly securing the cover to the base in the closed position.

In a related aspect, the portable humidor of the present invention can also include at least two shelves positioned in the first interior area. Means are provided for moving the at least two shelves from an inactive position wherein the shelves are in overlying vertical registry, to an active position wherein the shelves assume a spaced apart offset relationship, thereby allowing access to each of the shelves, this movement is in response to movement of the cover from the closed to the open position. Additionally, the portable humidor can include at least two trays removably locatable on the above-described shelves and having tray inserts adapted to receive a plurality of cigars. The tray inserts include means for supporting the plurality of cigars in an isolated relationship relative to each other. In the preferred embodiment these tray inserts are fabricated from a permeable-shock-absorbing material defining channels for supporting the cigars. The permeable-shock-absorbing tray inserts as well as the permeable-shock-absorbing base insert described above, can also include a plurality of slots, each being located adjacent to one of the channels formed in the foam inserts. The slots are adapted to receive strips of wood, preferably cedar, for aiding in the proper aging of the cigars stored in the portable humidor.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

Figure 1:
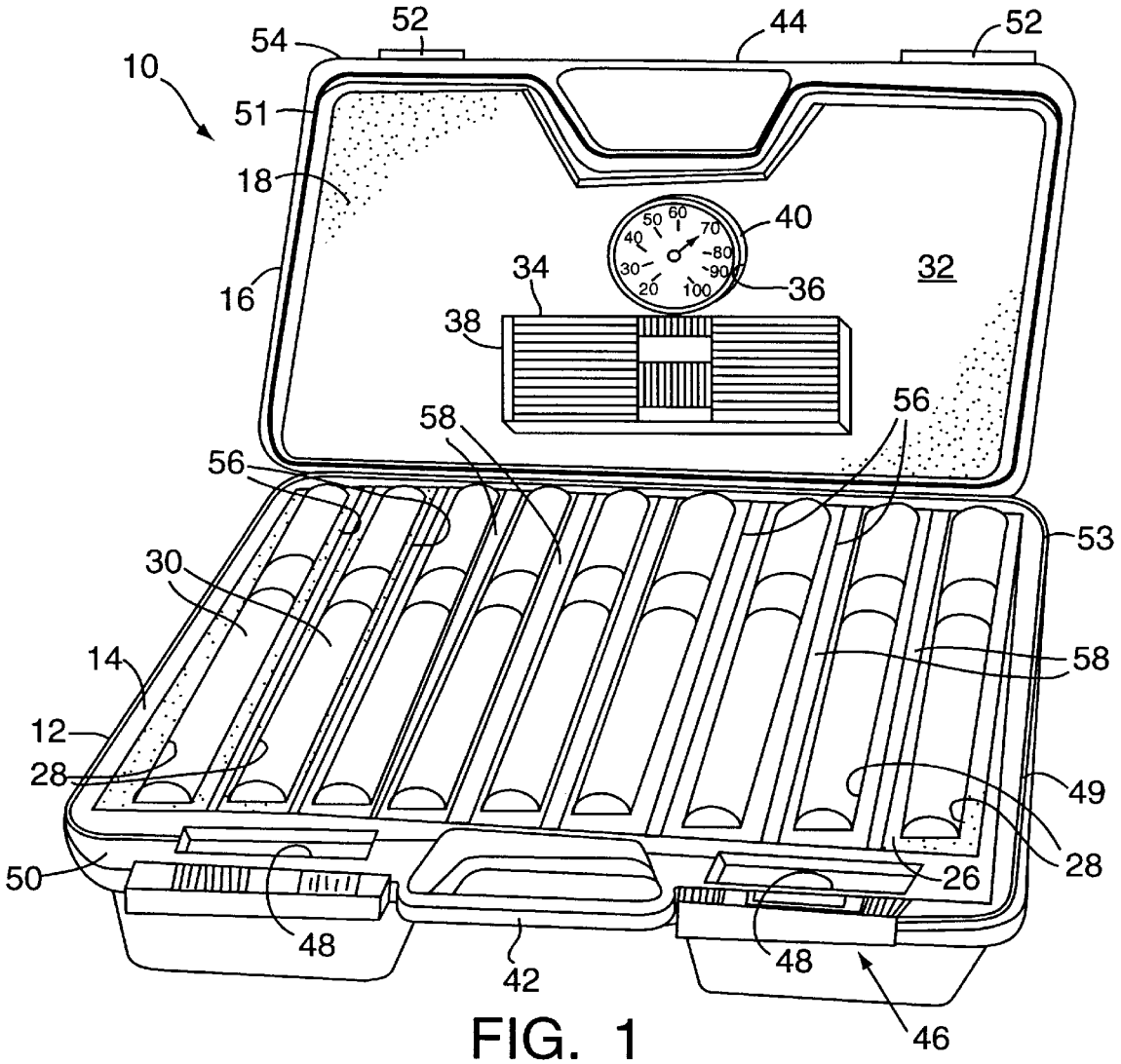
FIG. 1 is a perspective view of the portable humidor of the present invention shown in the open position.
Figure 3:
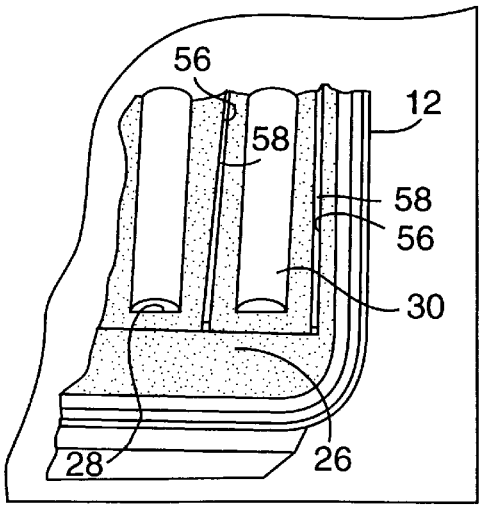
FIG. 3 is a perspective view of the humidor of FIG. 1 shown in the closed position.
Figure 2:
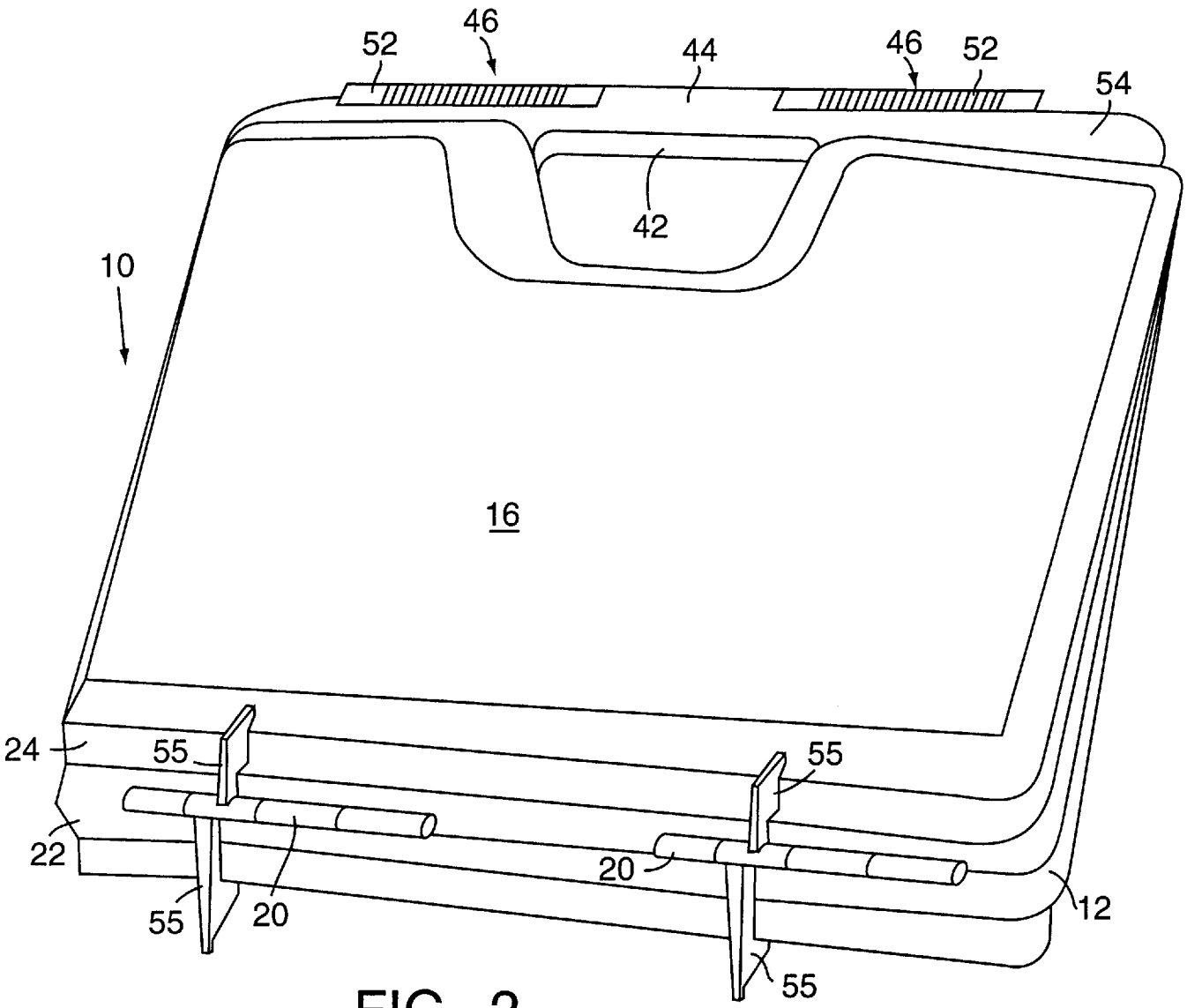
FIG. 2 is a fragmentary view of the portable humidor of FIG. 1 taken from the right side.

Turning to the drawings and first referring to FIG. 1, the preferred embodiment of a portable humidor there shown and generally designated as 10, comprises a base 12, defining a first interior area 14 and a cover 16 defining a second interior area 18. As best shown in FIG. 2, the cover and base, 12 and 16 respectively, are hingedly coupled to each other for movement between an open and a closed position via hinges 20 attached to the rear surfaces 22 and 24 of the base and cover, 12 and 16 respectively. As shown in FIGS. 1 and 3, means for retaining a plurality of cigars in an isolated relationship is provided, and preferably is in the form of at least one permeable-shock-absorbing insert 26 positioned in the base 12 and defining a plurality of channels 28, each adapted to receive and retain a cigar 30. In addition, a permeable-shock-absorbing liner 32 is positioned in the second interior area 18 and coupled to the cover 16. The liner 32 defines at least two cutouts 34 and 36 adapted to receive a humidifier 38, for regulating and maintaining humidity levels in the portable humidor 10, and a hygrometer 40, for measuring and indicating the humidity levels. Both the humidifier 38, and the hygrometer 40 are coupled to the cover 16. The permeable-shock-absorbing insert 28 and the liner 32 as described herein, can be fabricated from a suitable material, such as, but not limited to an open or closed cell foam. In the preferred embodiment, the base 12 and the cover 16 are each made from a suitable torsionally rigid material, such as but not limited to a semi-rigid injection-molded plastic, or a luggage-grade-high impact plastic.

Referring back to FIGS. 1 and 2, the base 12 defines an integral handle section 42. Similarly, the cover 16 defines an integral mating handle section 44, such that when the cover 16 is in the previously described closed position, the integral handle and mating handle sections, 42 and 44 respectively, meet, forming a single handle. In addition, the portable humidor 10 includes means 46, for releasably sealingly securing the cover 12 to the base 16. In the preferred embodiment these means 46 comprise locking members 48 coupled to the front 50 of the base 12 and slidable members 52 defining interior areas of a shape complimentary to the shape of the locking members 48, the sliding members being slidably attached to the front surface 54 of the cover 16. During operation, when the cover 16 is in the closed position the slidable members 52 can be positioned over the locking members 48, thereby releasably, sealingly securing the cover 16 to the base 12. The base 12 and the cover 16 define first and second sealing surfaces 49 and 51 respectively, with the first sealing surface having sealing means 53 mounted to it. Sealing means 53 is preferably in the form of an "o"-ring, however, the invention is not limited in this regard as other types of sealing means, for example, a rubber or other type of gasket may be substituted without departing from the broader aspects of the present invention. When the cover 16 is moved from the open to the closed position, the first and second sealing surfaces, 49 and 51 respectively, each abut and compress the sealing means 53, thereby sealing the humidor against the ingress of air, making it vapor tight. In addition, and as shown in FIG. 2, the rear surfaces 20 and 22 of the base and cover, 12 and 16 respectively define at least two feet 55 for standing the portable humidifier 10 in an upright position.

Still referring to FIG. 1, the aforementioned permeable-shock-absorbing insert 26 defines a plurality of slots 56, each slot being positioned adjacent to one of the above-described channels 28. A strip or dowel of wood 58, preferably cedar, is positioned in each of the slots 56 to aid in the aging process of the cigars stored in the portable humidor 10.

Figure 4:
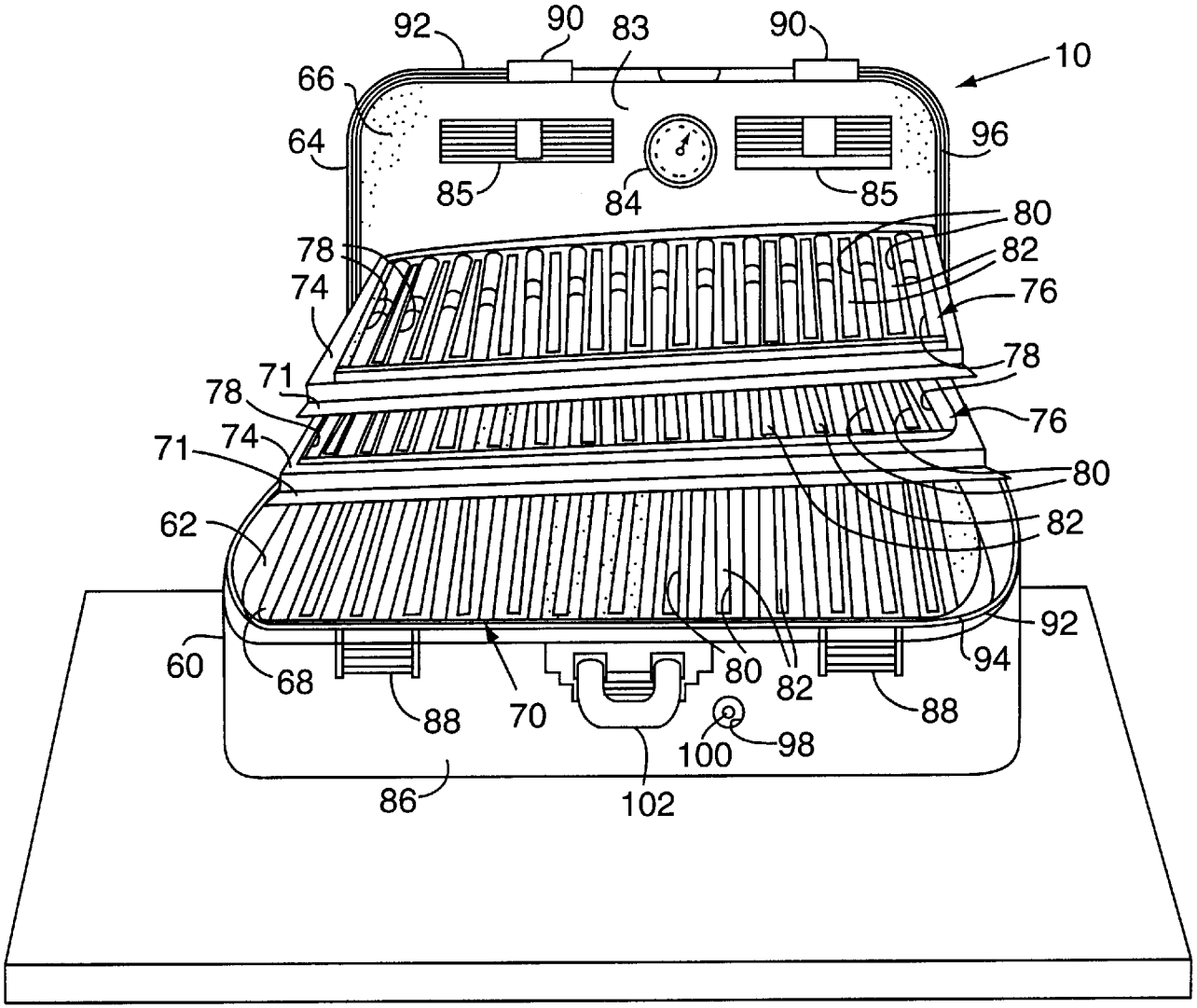
FIG. 4 is a perspective view of an alternate embodiment of the portable humidor of FIG.
Figure 5:
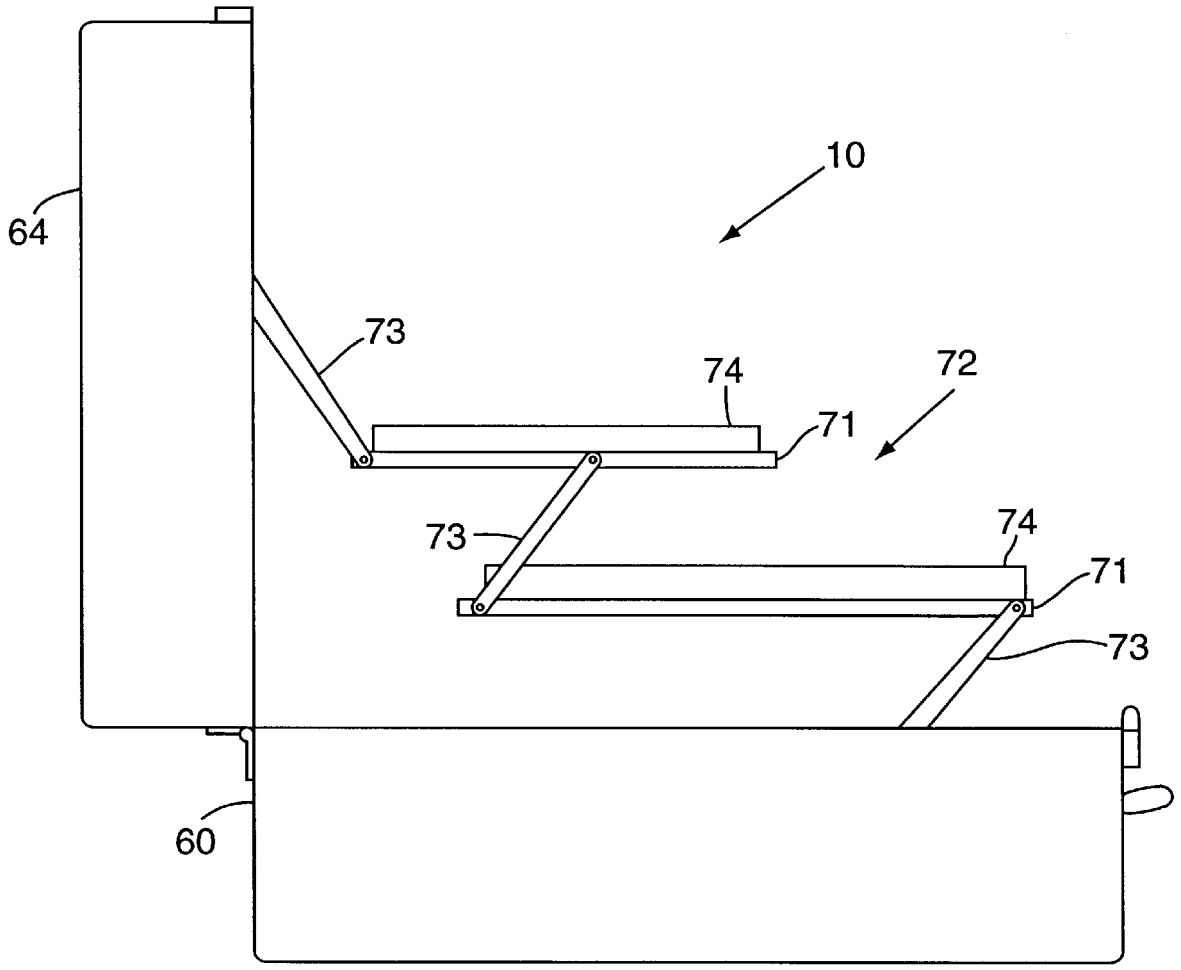
FIG. 5 is a side elevational view of the portable humidor of FIG. 4, taken from the left side.

Turning next to FIG. 4, an alternate embodiment of the portable humidor 10 described above is there shown and comprises a base 60 defining a first interior area 62, and a cover 64 defining a second interior area 66. A permeable-shock-absorbing base insert 68 is positioned in the first interior area and defines means 70 for supporting a plurality of cigars in an isolated relationship relative to one another. Preferably, the means 70 include a plurality of channels formed in the permeable-shock-absorbing base insert 68, each for supporting an individual cigar. In addition, at least two shelves 71 are positioned in the first interior area 62 and include means for moving the shelves from an inactive position, wherein they are in overlying vertical registry in the first interior area, to an active position, wherein the shelves assume a spaced apart offset relationship relative to one another. The movement of the shelves 71 occurs in response to movement of the cover from the closed to the open position. Preferably, and as illustrated in FIG. 5, the means 72 for moving the shelves comprises a plurality of pivoted link arms 73 connecting the cover 64 to the shelves 71, the shelves to each other, and the shelves to the base 60. Accordingly, as the cover 16 is moved from the aforementioned closed to the open position, the pivoted link arms 73 pivot about their connection points and act to lift the shelf from overlying registry to a spaced apart offset relationship.

As shown in FIG. 4, at least two trays 74 are provided and are removably locatable on the at least two shelves 71. Each of the trays 74 includes means 76 for supporting a plurality of cigars in isolated relationship relative to one another. In the preferred embodiment the means 76 comprises a permeable-shock-absorbing tray insert defining a plurality of channels 78 for retaining the cigars. In addition, the permeable-shock-absorbing base and tray inserts, 68 and 76 respectively, each define a plurality of slots 80 adapted to receive a plurality of wooden strips or dowels 82. The wooden strips or dowels 82 are preferably made from cedar to aid in the aging of the cigars. The permeable-shock-absorbing base insert 68 and the permeable-shock-absorbing tray inserts 76 are made from a suitable material such as, but not limited to an open or close cell foam. In addition, the base and cover, 60 and 64 respectively, are made from a suitable material, such as, but not limited to a semi-rigid injection-molded plastic, or a luggage-grade-high impact plastic.

Turning to FIG. 4, a liner 83 is mounted in the second interior area 66 and defines at least two cutouts, one for receiving a hygrometer 84 and another for receiving at least one humidifier 85. The hygrometer and the humidifier, 84 and 85 respectively, are each coupled to the cover 64. A pair of clasps 88 are attached to a front surface 86 of the base 60 and a pair of protrusions 90 extend from a front surface 92 of the cover and are adapted to be received by the clasps 88. In addition, the base includes first sealing surface 92 having a sealing means 94 mounted thereon for sealing the humidor against the ingress of air and making the humidor vapor-tight. Preferably, the sealing means 94 is in the form of an "o"-ring, however, the present invention is not limited in this regard as other types of sealing means, such as a rubber or other type of gasket may be substituted without departing from the broader aspects of the present invention. Similarly, the cover 64 includes second sealing surface 96. When the cover 64 is moved from the opened to the closed position, the first and second sealing surfaces 92 and 96 respectively, coact to abut and compress the sealing means 94. The clasps 88 can then engage the protrusions 90 and be actuated, thereby sealing the portable humidor 10. Once the portable humidor 10 is sealed, it may become necessary to allow for the ingress of air to the humidors interior. Accordingly, the front surface 86 of the base 60 defines aperture 98 over which is mounted aeration means 100 which can be selectively actuated between a closed position where no air can enter the humidor through the aperture, and an open position allowing air to enter. In the preferred embodiment, the aeration means comprises a valve. A handle 102 is coupled to the base 60, thereby allowing the portable humidifier 10 to be carried when in the aforementioned closed position.

While preferred embodiments have been shown and described, various modifications and substitutions may be made without departing from the spirit and scope of the invention. Accordingly, it is to be understood that the present invention has been described by way of example, and not by limitation.

What is claimed is:

1. A portable humidor comprising:

a base defining a first interior area;

a cover hingedly connected to the base and defining a second interior area, the cover being movable between an open and a closed position;

supporting means for supporting a plurality of cigars in an isolated relationship relative to one another in the base;

a permeable-shock-absorbing liner positioned in the second interior area and coupled to the cover, the liner defining at least two cutouts;

at least one humidifier coupled to the cover and positioned in at least one of the cutouts, for maintaining a proper humidity level in the humidor;

a hygrometer coupled to the cover and positioned in one of the cutouts for measuring the humidity level in the humidor;

sealing means interposed between the cover and the base for sealing the portable humidor when the cover is in the closed position; and means for releasably, sealingly securing the cover to the base, such that the humidor is substantially vapor-tight.

2. A portable humidor as defined by claim 1, wherein the supporting means comprises at least one permeable-shock-absorbing insert positioned in the base and defining a plurality of channels, each channel being adapted to receive a cigar.

3. A portable humidor as defined by claim 2, further comprising:

at least two shelves positioned in the first interior area and including means for moving the at least two shelves from an inactive position, wherein the shelves are in overlying vertical registry relative to each other, to an active position, wherein the shelves assume a spaced apart offset relationship allowing access to the shelves, in response to movement of the cover from the closed to the open position; and wherein the supporting means comprises at least two trays removably locatable on the at least two shelves for receiving and retaining a plurality of cigars.

4. A portable humidor as defined by claim 3, wherein the supporting means further comprises at least two permeable-shock-absorbing tray inserts adapted to be received in the at least two trays, each defining a plurality of channels adapted to receive a plurality of cigars.

5. A portable humidor as defined by claim 4, wherein:

the at least two permeable-shock-absorbing tray inserts are formed from open celled foam.

6. A portable humidor as defined by claim 4, wherein:

the at least two permeable-shock-absorbing tray inserts, and the base insert each define a plurality of slots located adjacent to the channels, each slot adapted to receive a strip of wood.

7. A portable humidor as defined by claim 6, wherein the strips of wood are made from cedar.

8. A portable humidor as defined by claim 1, wherein:

a respective one of the cover or the base defines an aperture extending therethrough; and wherein the portable humidor further comprises aeration means coupled to the portable humidor in communication with the aperture for selectively allowing the ingress of air into the portable humidor.

9. A portable humidor as defined by claim 8, wherein the aeration means comprises a valve selectively movable between an open and a closed position.

10. A portable humidor as defined by claim 1, wherein:

the cover defines a first sealing surface;

the base defines a second sealing surface; and wherein the sealing means is interposed between and engaged with the first and second sealing surfaces when the cover is in the closed position, thereby compressing the sealing means and creating a substantially vapor tight seal.

11. A portable humidor as defined by claim 10, wherein the sealing means comprises an o-ring.

12. A portable humidor as defined by claim 10, wherein the sealing means comprises a gasket.

13. A portable humidor as defined by claim 1, wherein the cover defines a first handle portion and the base defines a second handle portion, such that when the cover is moved from the open to the closed position, the first and second handle portions abut one another forming a single handle.

14. A portable humidor as defined by claim 1, wherein the base and the cover are formed from a semi-rigid injection molded plastic.

15. A portable humidor as defined by claim 1, wherein the base and the cover are formed from a luggage grade plastic.

16. A portable humidor comprising:

a base defining a first interior area;

a cover hingedly connected to the base and defining a second interior area, the cover being movable between an open and a closed position;

at least one permeable-shock-absorbing insert positioned in the base and defining a plurality of channels, each channel being adapted to receive a cigar;

a permeable-shock-absorbing liner positioned in and coupled to the interior area of the cover, the liner defining at least two cutouts;

at least one humidifier coupled to the cover and positioned in at least one of the cutouts, for maintaining a proper humidity level in the humidor;

a hygrometer coupled to the cover and positioned in one of the cutouts for measuring the humidity level in the humidor;

at least two shelves positioned in the first interior area and including means for moving the at least two shelves from an inactive position, wherein the shelves are in an overlying vertical registry relative to each other, to an active position, wherein the shelves assume a spaced apart offset position allowing access to the shelves, in response to movement of the cover from the closed to the open position;

at least two trays removably locatable on the at least two shelves for receiving and retaining a plurality of cigars;

at least two permeable-shock-absorbing tray inserts adapted to be received in the at least two trays, each defining a plurality of channels adapted to receive a plurality of cigars; and sealing means interposed between the base and the cover; and means for releasably, sealingly securing the cover to the base, such that when the cover is moved from the open to the closed position, the cover and the base abut and compress the sealing means and the humidor is substantially vapor-tight.

17. A portable humidor as defined by claim 16, further comprising aeration means for selectively allowing or preventing the ingress of air when the cover is in the closed position.

18. A portable humidor as defined by claim 17, wherein the aeration means is a valve mounted to the humidor and operable between a closed position preventing the ingress of air, and an open position, allowing the ingress of air.

19. A portable humidor as defined by claim 16, wherein the sealing means is an o-ring.

20. A portable humidor as defined by claim 16, wherein the means for moving the at least two shelves comprises a plurality of pivoted linking arms connecting the at least two trays to one another and to the cover and base, thereby allowing the at least two shelves to assume an offset spaced apart relationship when the cover is moved from the closed to the open position.

* * * * *

UNITED STATES PATENT AND TRADEMARK OFFICE

CERTIFICATE OF CORRECTION

PATENT NO. : 5,803,247

DATED : September 8, 1998

INVENTOR(S) : Jeremy S. Holmes, Mark W. Trahan and Peter V. Disch

It is certified that error appears in the above-identified patent and that said Letters Patent is hereby corrected as shown below:

On the title page, item [76] inventors:

Line 2, please delete "Marc" and substitute --Mark--.

Signed and Sealed this

Twenty-sixth Day of January, 1999

*Attest:*

*Attesting Officer*

*Acting Commissioner of Patents and Trademarks*